US006029470A

United States Patent [19]

Joo et al.

[11] Patent Number: 6,029,470

[45] Date of Patent: Feb. 29, 2000

[54] REFRIGERATOR WITH COOL AIR DISPERSING BLADES

[75] Inventors: Tae Ho Joo; Sun Gyou Lee, both of Kwangju, Rep. of Korea

[73] Assignee: Samsung Electronics Co., Ltd., Suwon, Rep. of Korea

[21] Appl. No.: 09/143,645

[22] Filed: Aug. 31, 1998

[30] Foreign Application Priority Data

Aug. 29, 1997 [KR] Rep. of Korea ..... 97-43028
Aug. 30, 1997 [KR] Rep. of Korea ..... 97-44866

[51] Int. Cl.[7] ..... F25D 17/08

[52] U.S. Cl. ..... 62/408; 62/426

[58] Field of Search ..... 62/407, 408, 414, 62/419, 426, 440, 441, 455

[56] References Cited

U.S. PATENT DOCUMENTS 5,644,437 7/1997 Park et al. ..... 62/441
5,718,123 2/1998 Park et al. ..... 62/419
5,735,138 4/1998 Park et al. ..... 62/455
5,755,112 5/1998 Kang ..... 62/419
5,775,124 7/1998 Park et al. ..... 62/414
5,778,688 7/1998 Park et al. ..... 62/408
5,799,500 9/1998 Kang ..... 62/407
5,802,867 9/1998 Kang ..... 62/440

*Primary Examiner*—William E. Tapolcai
*Attorney, Agent, or Firm*—Burns, Doane, Swecker & Mathis, L.L.P.

[57] ABSTRACT

Disclosed is a refrigerator having a cool air dispersing device capable of dispersing cool air vertically. In a duct of a cooling compartment are installed many vertical dispersing blades of planar plate shape for dispersing cool air flowing thereinto vertically. A vertical shaft is installed in the duct. Many horizontal dispersing blades of planar shape are installed on the shaft. The shaft is rotated by a motor, and a cam is installed on the shaft. The cam converts a rotational movement of the motor to an elevational/de-elevational movement of the vertical dispersing blades. Thus, the cool air is dispersed horizontally and vertically in the compartment, and the temperature in the compartment is maintained uniform. Further, if the blades are stopped, the cool air can be concentrated on a specific area.

9 Claims, 13 Drawing Sheets

REFRIGERATOR WITH COOL AIR DISPERSING BLADES

BACKGROUND OF THE INVENTION

1. Field of the Invention

The present invention relates to a refrigerator having a cabinet for forming a cooling compartment, and a duct for forming a passage of cool air, which is provided in an inner wall of the cooling compartment and has at least one cool air discharge port opened into the cooling compartment, and more particularly, relates to a refrigerator having a device for dispersing cool air uniformly into the cooling compartment.

2. Prior Art

In general, a refrigerator has a cabinet for forming a pair of cooling compartments, i.e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has bee proposed. In the refrigerator adopting the tri-dimensional cooling method, the cool air discharge ports are provided at both side walls as well as at the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend of using large-sized refrigerators.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

In conventional refrigerator having the device for dispersing cool air has a pair of cooling compartments 2 and 3 in a cabinet 1, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of teh cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 is comprised of a rotational shaft 131 having a vertical axis, cool air dispersing blades 132 assembled with the rotational shaft 131 at areas corresponding to the cool air discharge ports 16 respectively, and a driving motor 135 for rotating the rotational shaft 131. Each of the cool air dispersing blades 132 is comprised of three discs 136, 137 and 138. Each of the blade parts 133 and 134 are bent so that their cross section is a lax shape of alphabet S. The block parts 133 and 134 are bent to the opposite direction to each other.

In the refrigerator having the above-described constitution, when the driving motor 131 rotates the rotational shaft 131 at a low speed, the cool air flowing along the supply duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, since the blade parts 133 and 134 of the cool air dispersing device 130 are bent to be shaped into the lax alphabet S, left or right side of the fresh food compartment 3 may be supplied with the cool air sufficiently according to the rotational direction of the rotational shaft 131, and the smooth flow of cool air may be impeded by a vortex of the cool air formed about the cool air discharge ports 16.

Moreover, although such a conventional cool air dispersing device 130 can achieve the uniform distribution of the cool air horizontally, the vertical distribution of the cool air cannot be uniform sufficiently, so there is a limitation in realizing the uniform cooling throughout the overall area of the fresh food compartment 3.

SUMMARY OF THE INVENTION

The present invention has been proposed to overcome the above-described problems in the prior art, and accordingly it is the object of the present invention to provide a refrigerator having a cool air dispersing device capable of preventing vortex of cool air.

Another object of the present invention is to provide a refrigerator having a cool air dispersing device capable of distributing the cool air effectively in vertical and horizontal directions, simultaneously.

To achieve the above objects, the present invention provides a refrigerator comprising: a duct plate being installed on a side wall of a cooling compartment, said duct plate for forming a cool air duct in said side wall, said duct plate having at least one cool air discharge port opened into said cooling compartment, a plurality of vertical dispersing blades of planar plate shape being installed in said cool air duct so as to be capable of rotating with respect to a horizontal shaft, said vertical dispersing blades being disposed in parallel with each other, said vertical dispersing blades for dispersing cool air in said cool air duct vertically according to a rotational position thereof; a vertical shaft being disposed in said cool air duct vertically, said vertical shaft being capable of rotating, a plate being installed on said vertical shaft, said plate for supporting a part of said vertical dispersing blades, said plate being tilted at a predetermined angle; and a means for rotating said vertical shaft.

A supporting protrusion protrudes vertically from said vertical dispersing blade. The supporting protrusion is in contact with an adjacent vertical dispersing blade so that said vertical dispersing blade maintains a predetermined distance from said adjacent vertical dispersing blade. Here, said plate is in contact with said supporting protrusion formed on a lowermost vertical dispersing blade among said vertical dispersing blades.

Preferably, a plurality of horizontal dispersing blades are installed on said vertical shaft. The horizontal dispersing blades are rotated together with said vertical shaft, and disperse cool air in said cool air duct horizontally according to a rotational position thereof.

Furthermore, it is more preferable that said plate has a shape of a disc.

According to another embodiment of the present invention, a refrigerator is provided, which comprises: a duct plate being installed on a side wall of a cooling compartment, said cut plate for forming a cool air duct in said side wall, said duct plate having at least one cool air discharge port opened into said cooling compartment; a plurality of vertical dispersing blades of planar plate shape being installed in said cool air duct so as to be capable of rotating with respect to a horizontal shaft, said vertical dispersing blades being disposed in parallel with each other, said vertical dispersing blades for dispersing cool air in said cool air duct vertically according to a rotational position thereof; a vertical shaft being disposed in said cool air duct vertically so as to be capable of elevating/de-elevating vertically, said vertical shaft being capable of rotating; a plate being installed on said vertical shaft, said plate for supporting a part of said vertical dispersing blade; a means for rotating said vertical shaft; and a means for elevating/de-elevating said vertical shaft while said vertical shaft is being rotated by said rotating means.

The elevating/de-elevating mean preferably comprises: an elevation/de-elevation cam being installed on said vertical shaft, said elevation/de-elevation cam having a cam profile elevating/de-elevating vertically; and a cam protrusion being formed on a part of said duct plate, said cam interacting with said elevation/de-elevation cam.

According to the present invention, vortex of cool air does not occur around the cool air dispersing blades. Furthermore, the uniform distribution of cool air can be realized in vertical and horizontal directions.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
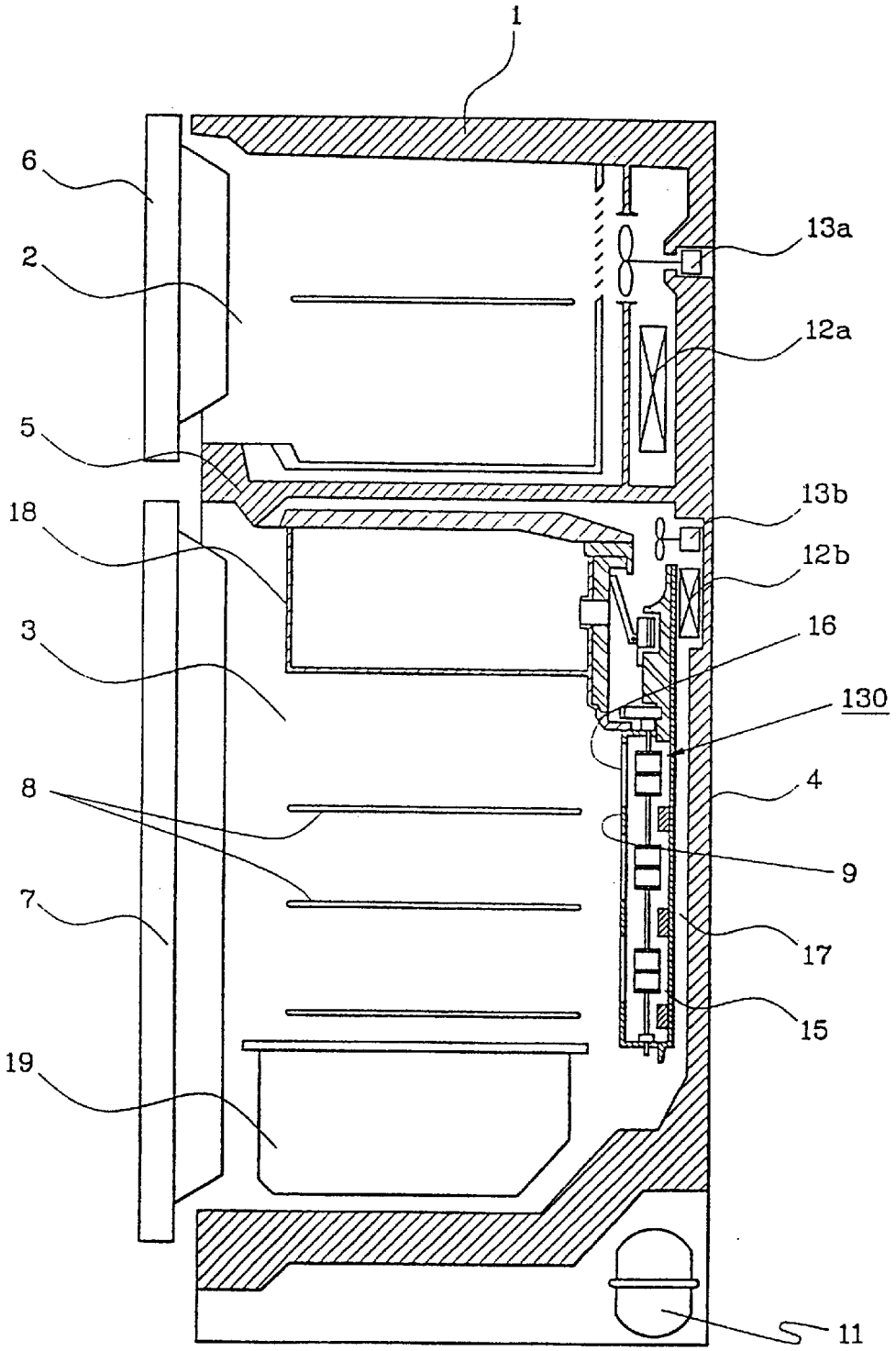
FIG. 1 (PRIOR ART)
FIG. 1 is a side sectional view of a conventional refrigerator having cool air dispersing blades.
Figure 2:
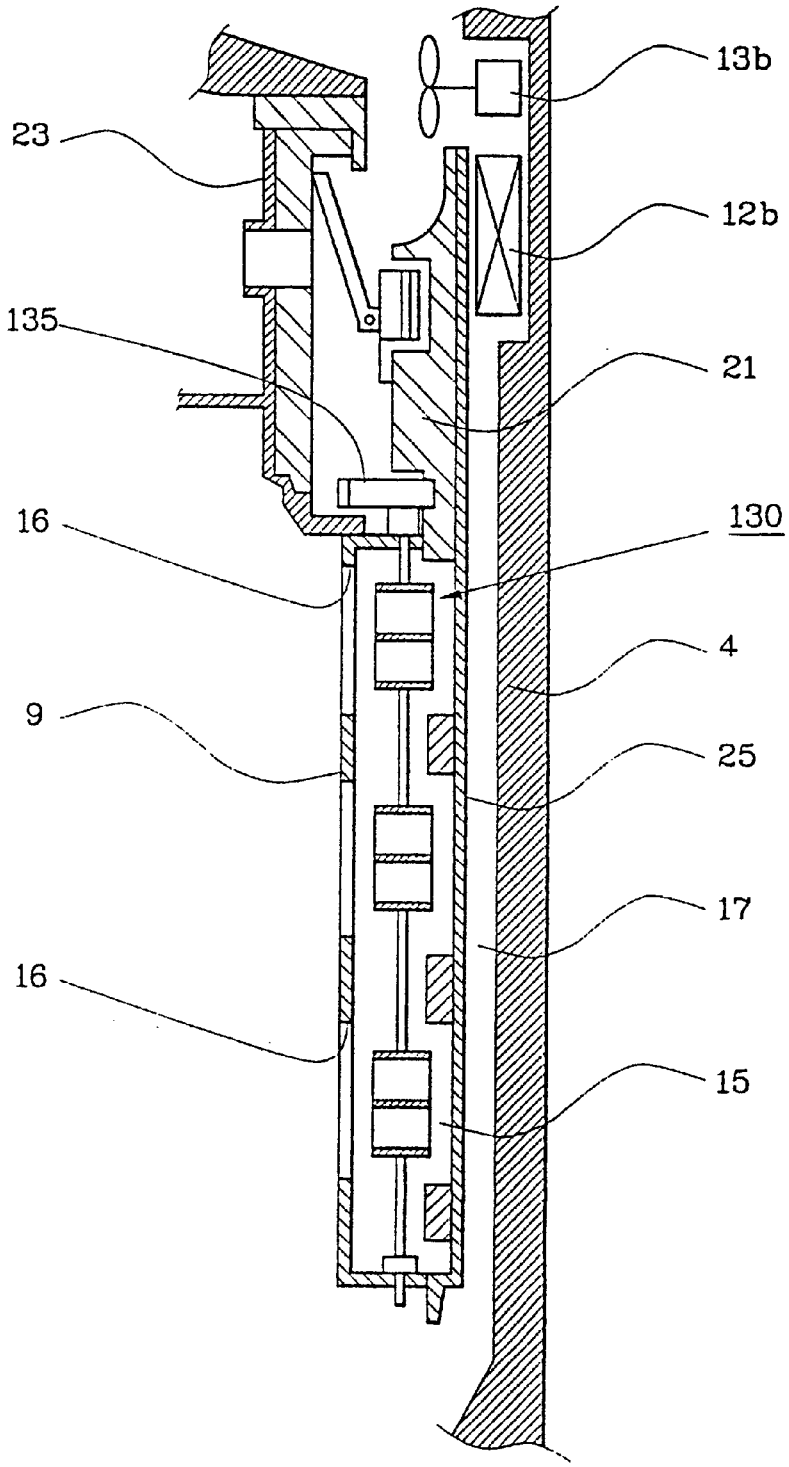
FIG. 2 (PRIOR ART)
FIG. 2 is a partial enlarged sectional view of FIG. 1.
Figure 3:
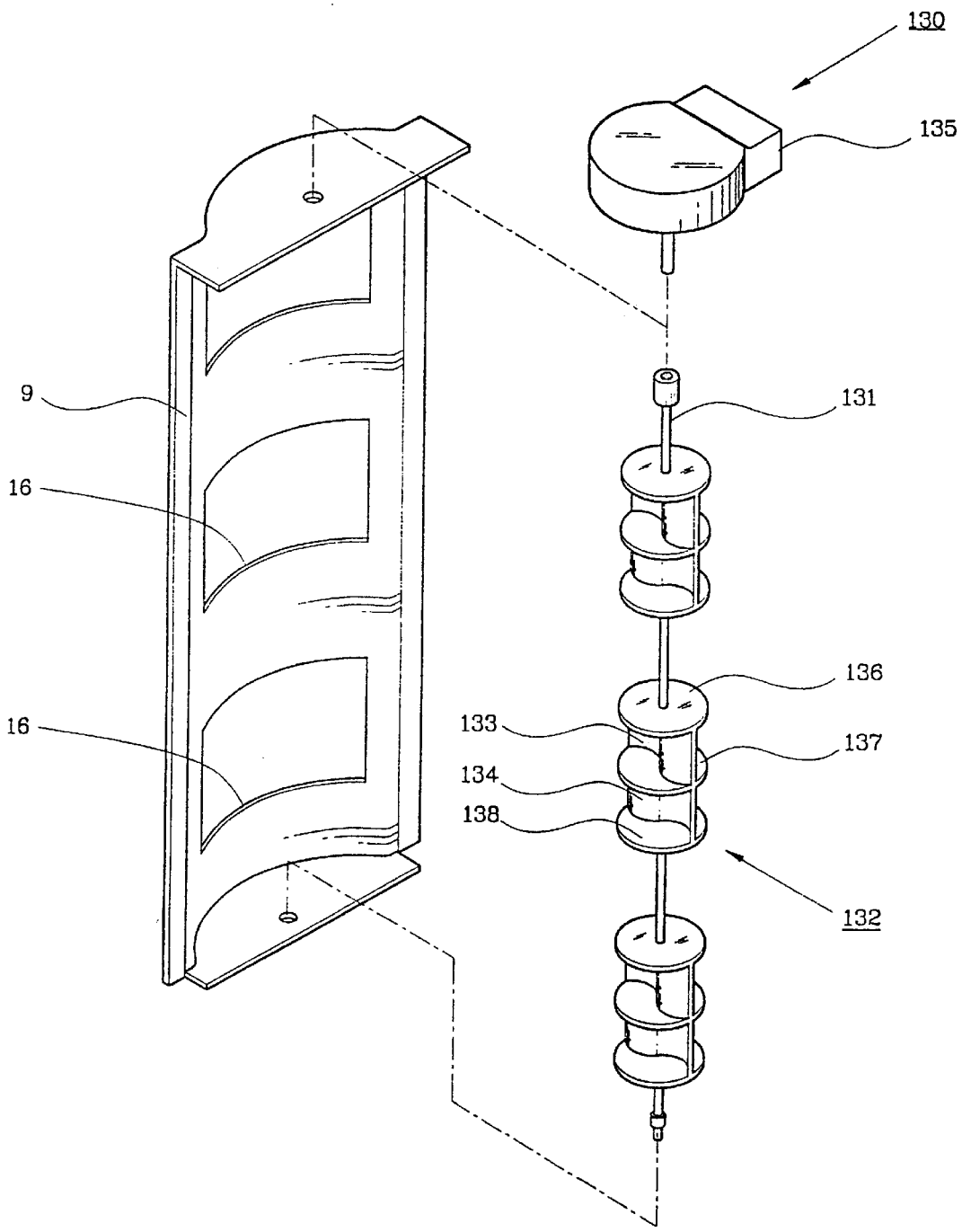
FIG. 3 (PRIOR ART)
FIG. 3 is an enlarged exploded perspective view of main elements of FIG. 2.

Hereinafter, the present invention will be described in detail with reference to the accompanying drawings. Parts identical to those in the conventional refrigerator shown in FIGS. 1 through 3 will be referred to with the same reference numerals, and the description thereof will be omitted.

Figure 4:
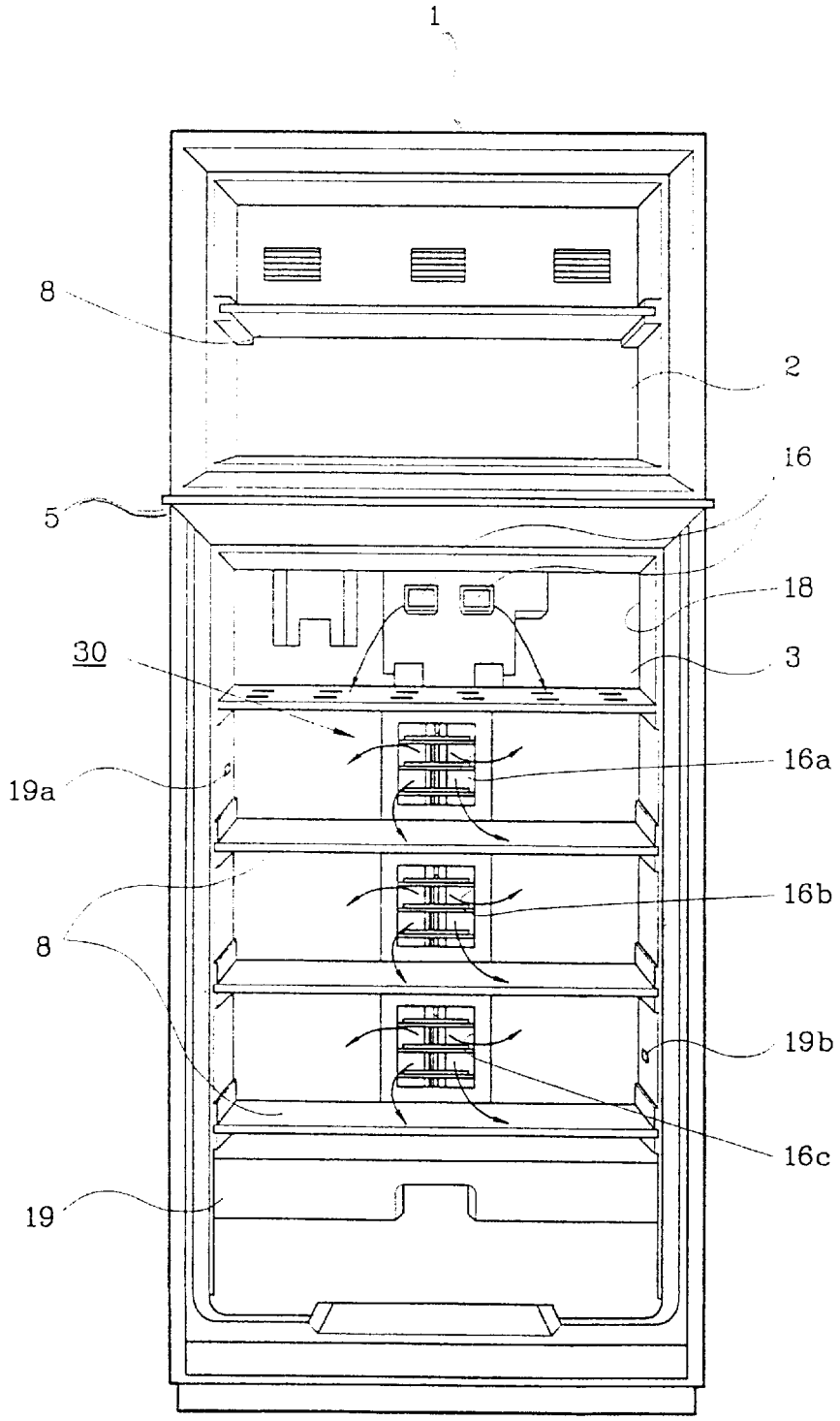
FIG. 4 is a front view of a refrigerator according to the first embodiment of the present invention.
Figure 5:
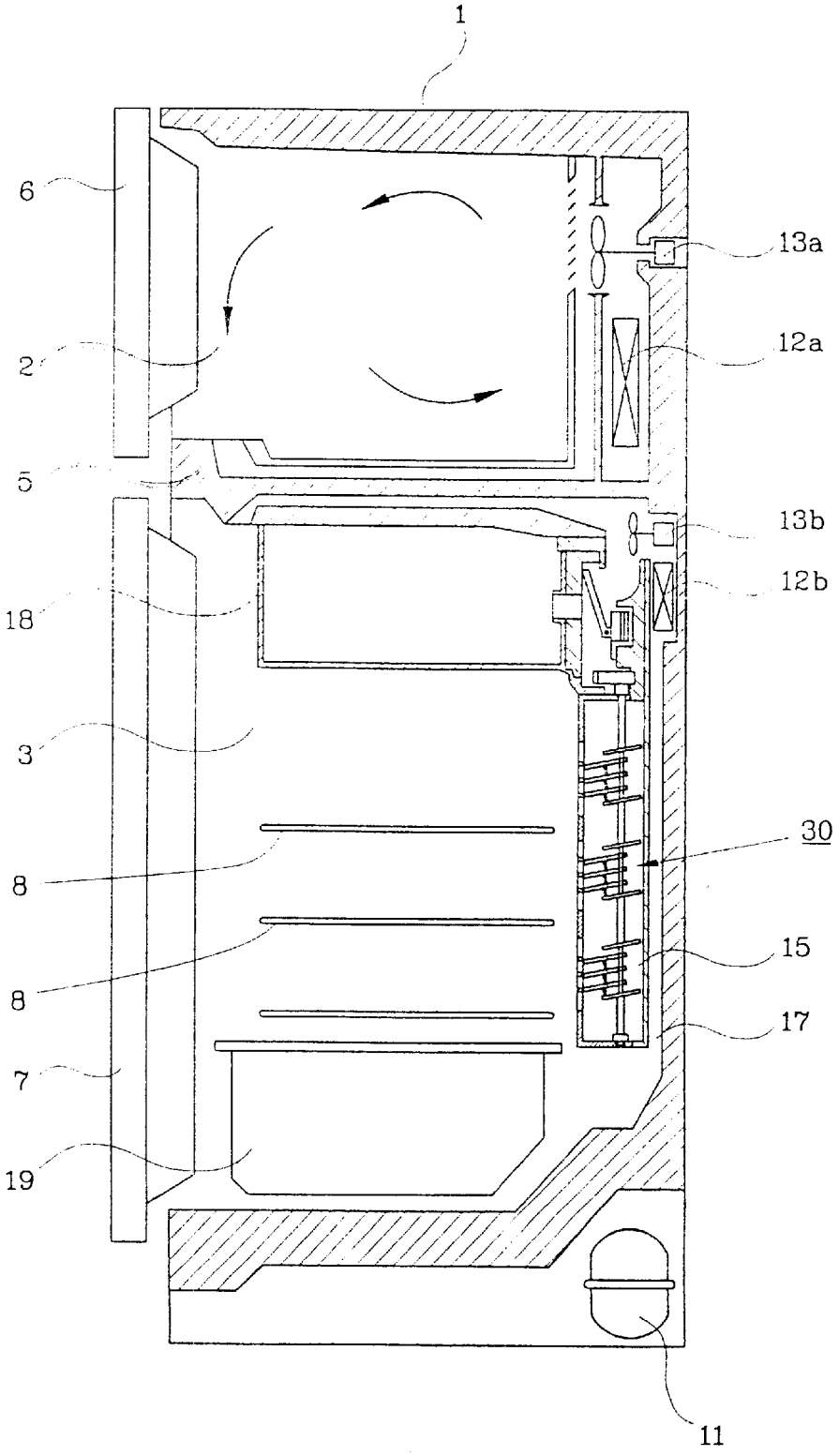
FIG. 5 is a side sectional view of FIG. 4.
Figure 6:
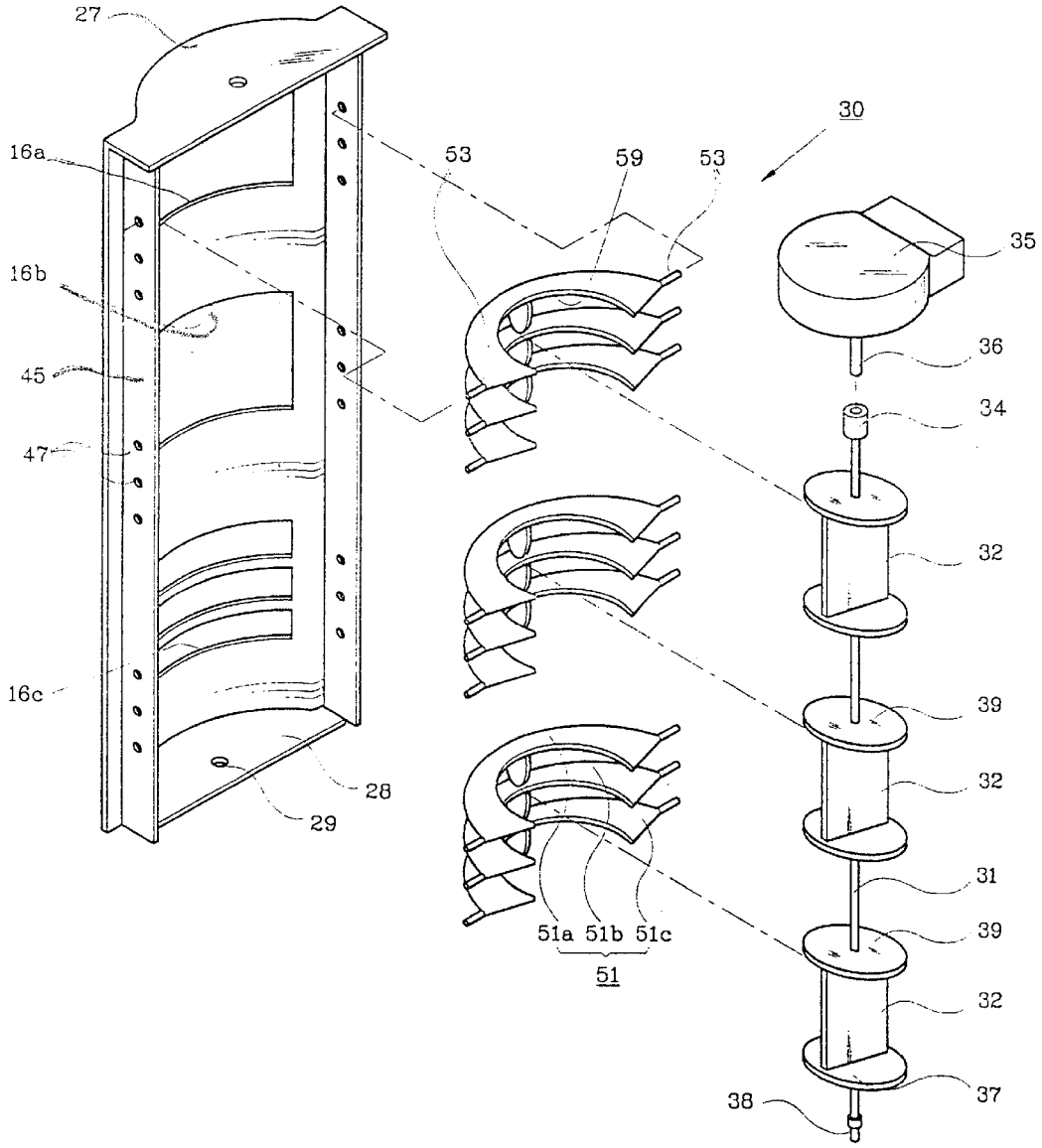
FIG. 6 is an enlarged exploded perspective view of a cool air dispersing device shown in FIGS. 4 and 5.
Figure 7:
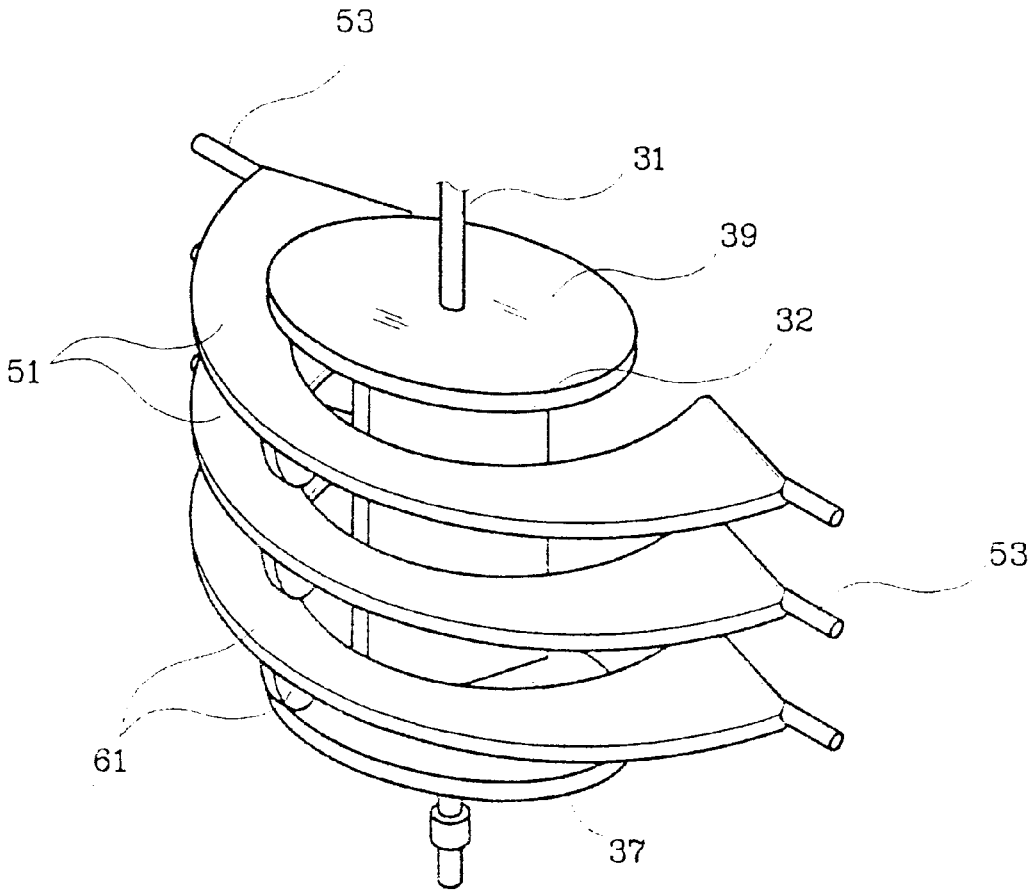
FIG. 7 is a partial enlarged view of the assembled state of FIG. 6.

FIG. 4 is a front view of a refrigerator according to the first embodiment of the present invention, and FIG. 5 is a side sectional view of FIG. 4. The refrigerator has, as the conventional refrigerator which has been illustrated with reference to FIGS. 1 through 3, a cabinet 1 forming freezing compartment 2 and a fresh food compartment 3 which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon is installed, which divide the fresh food compartment 3 into three stratified area, i.e., an upper area, a middle area, and a lower area. A special fresh chamber 18 for storing food which requires a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a* and 12*b* is supplied into the corresponding cooling compartments 2 and 3 by the freezing compartment fan 13*a* and the fresh food compartment fan 13*b*.

A supply duct 15 and a return duct 17 are provided in the rear of the fresh food compartment 3. The cool air generated by the fresh food compartment evaporator 12*b* is blown by the fresh food compartment fan 13*b* so as to be supplied into the fresh food compartment 3 via the supply duct 15 and the cool air discharge ports 16. A device 30 for dispersing cool air is installed in the supply duct 15.

A pair of temperature sensors 19*a* and 19*b* are installed in the fresh food compartment 3. The temperature sensors 19*a* and 19*b* comprise a first temperature sensor 19*a* installed at the upper left area of the fresh food compartment 3, and a second temperature sensor 19*b* installed at the lower right area of the fresh food compartment 3.

FIGS. 6 through 9 show the cool air dispersing device 30. As shown in the figures, three cool air discharge ports 16*a,* 16*b* and 16*c* are provided on the duct plate 27. The discharge ports 16*a,* 16*b* and 16*c* respectively correspond to three stratified areas in the fresh food compartment 3.

The cool air dispersing device 30 comprises a plurality of vertical dispersing blades 51 disposed adjacently to the discharge ports 16*a,* 16*b* and 16*c* in the supply duct 15, a vertical shaft 31 disposed vertically in the supply duct 15, a plurality of horizontal dispersing blades 32 installed on the vertical shaft 31, and a driving motor 35 for rotating the vertical shaft 31. Each of the discharge ports 16*a,* 16*b* and 16*c* correspond to three vertical dispersing blades 51*a,* 51*b* and 51*c*.

The vertical dispersing blades 51 are formed into an arc-shape plate, and horizontal shafts 53 are formed at both sides thereof. Furthermore, a cut part 59 is formed at the rear area of the vertical dispersing blades 51 so as to accommodate the vertical shaft 31 and the horizontal dispersing blades 32. On the flanges 45 provided at both sides of the duct plate 27 are formed a plurality of shaft holes 45, and the horizontal shafts 53 of the vertical dispersing blades 51 are inserted into the shaft holes 45. Therefore, the vertical dispersing blades 51 are rotatable around the horizontal shaft 53.

A supporting protrusion 61 protrudes at the lower surface of each of the vertical dispersing blades 51. Such a supporting protrusion 61 can be provided only at upper two vertical dispersing blades 51*a* and 51*b* except for the lowermost vertical dispersing blades 51*c* among three vertical dispersing blades 51 disposed near the respective discharge ports 16*a,* 16*b* and 16*c*.

The end of the supporting protrusion 61 us contacted with the upper surface of other vertical dispersing blades 51 disposed at the lower area thereof, whereby the vertical dispersing blades 51 are supported so as to be parallel with each other by a predetermined distance. Furthermore, when the lowermost vertical dispersing blade 51*c* is rotated upward, the upper two vertical dispersing blades 51*a* and 51*b* are rotated by the supporting protrusions 61 together therewith.

The upper end 34 of the vertical shaft 31 is coupled with the shaft 36 of the driving motor 35, and the lower end 38 thereof is inserted into a supporting hole 29 formed on the lower flange 28 of the duct plate 27. Thus, the vertical shaft 31 is supported so as to be capable of rotating. The driving motor 35 is a stepping motor which can control the angular position thereof.

Meanwhile, on the vertical shaft 31 is installed a cam plate 37 interacting with the lowermost vertical dispersing blade 51*c* among three vertical dispersing blades 51. The cam plate 37 has a shape of a disc, and is tilted with respect to the vertical shaft 31 at a predetermined angle. Further, the cam plate 37 is coaxially disposed with the vertical shaft 31, and rotates together with the vertical shaft 31.

The edge of the cam plate 37 supports the supporting protrusion 61 of the lowermost vertical dispersing blade 51*c*. Therefore, while the vertical shaft 31 is rotated by the driving motor 35, the supporting protrusion 61 of the lowermost vertical dispersing blade 51*c* elevates/de-elevates along the edge of the cam plate 37, whereby the other vertical dispersing table 51*a* and 51*b* supported by the supporting protrusions 61 in parallel with each other are rotated upward around the horizontal shaft 53.

Meanwhile, three horizontal dispersing blades 32 are installed on the vertical shaft 31. The horizontal dispersing blades 32 correspond to the discharge ports 16*a,* 16*b* and 16*c,* respectively. The horizontal dispersing blade 32 is formed into a rectangular plate. Furthermore, the lower end of the horizontal dispersing blade 32 is connected with the cam plate 37. A guide plate 39 is provided on the upper end of the horizontal dispersing blade 32. The guide plate 39 is tilted so as to be parallel with the cam plate 37. The guide plate 39 also guides cool air like the vertical dispersing blades 51 so that the cool air is dispersed vertically while the vertical shaft 31 is rotating.

The operation of the refrigerator according to the present invention having such a construction is as follows.

Figure 8:
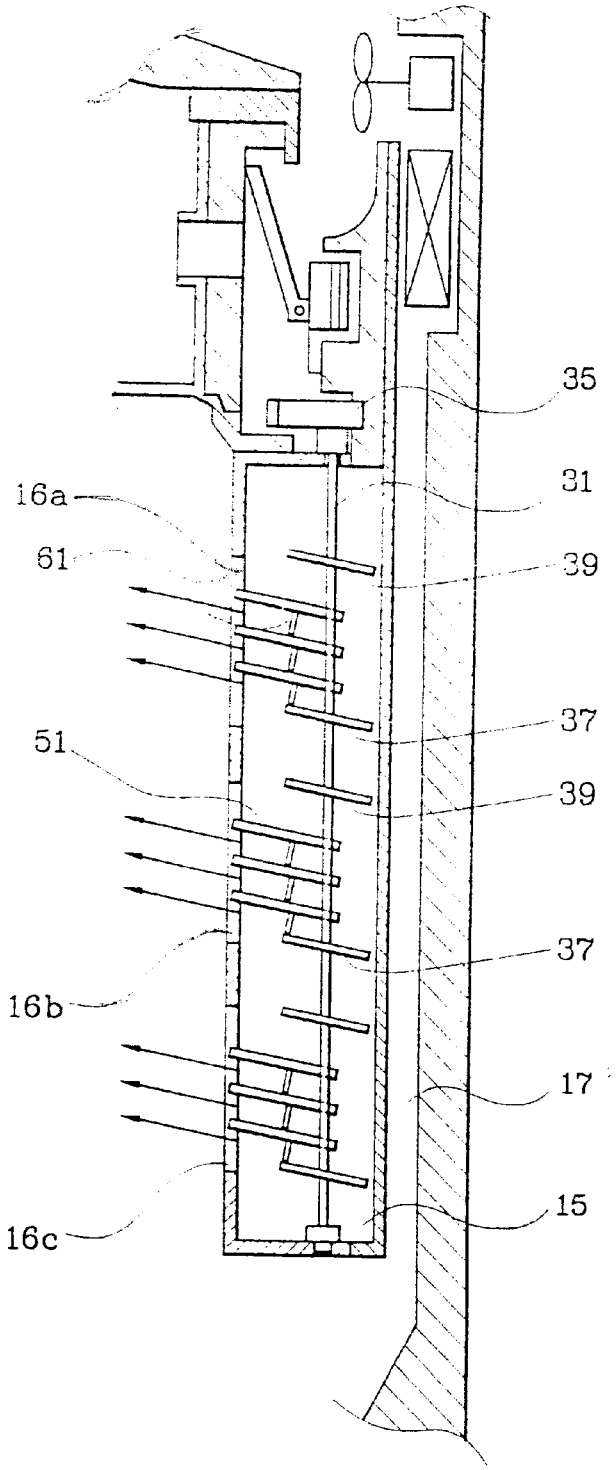
FIGS. 8 and 9 are side sectional views of the assembled state of FIG. 6.
Figure 9:
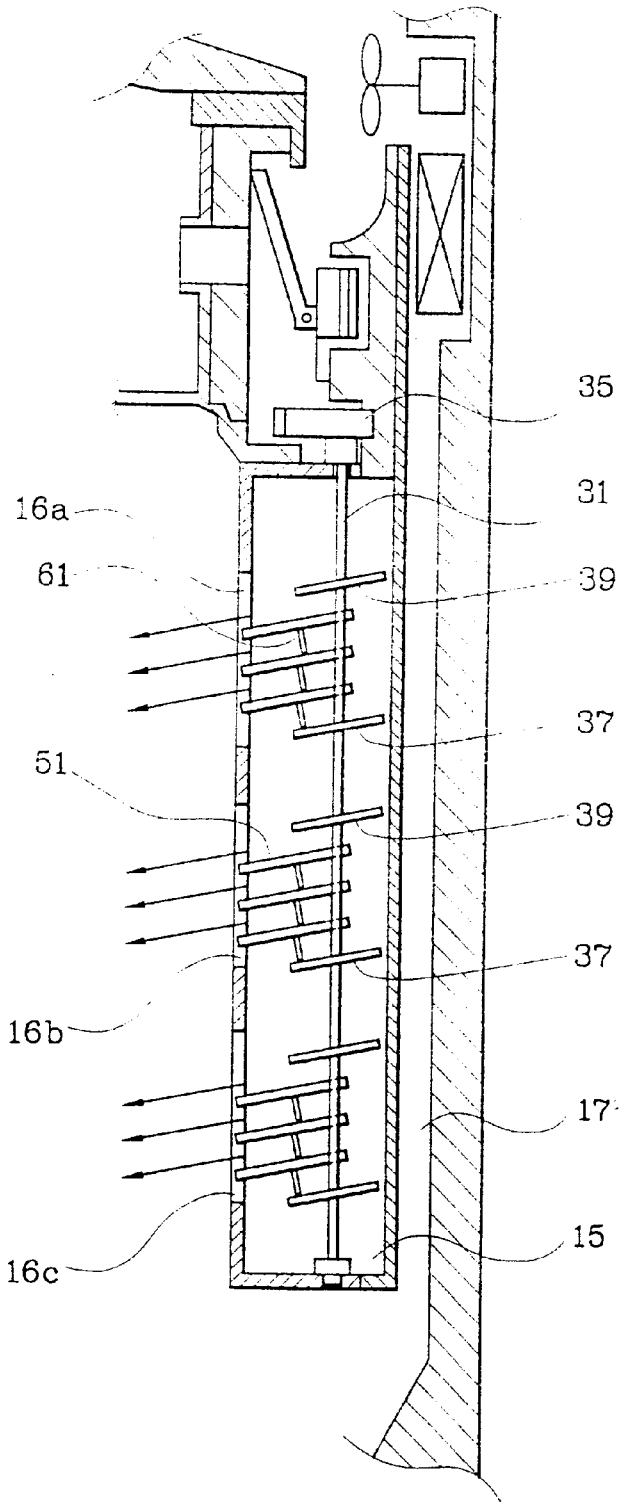
Figure 10:
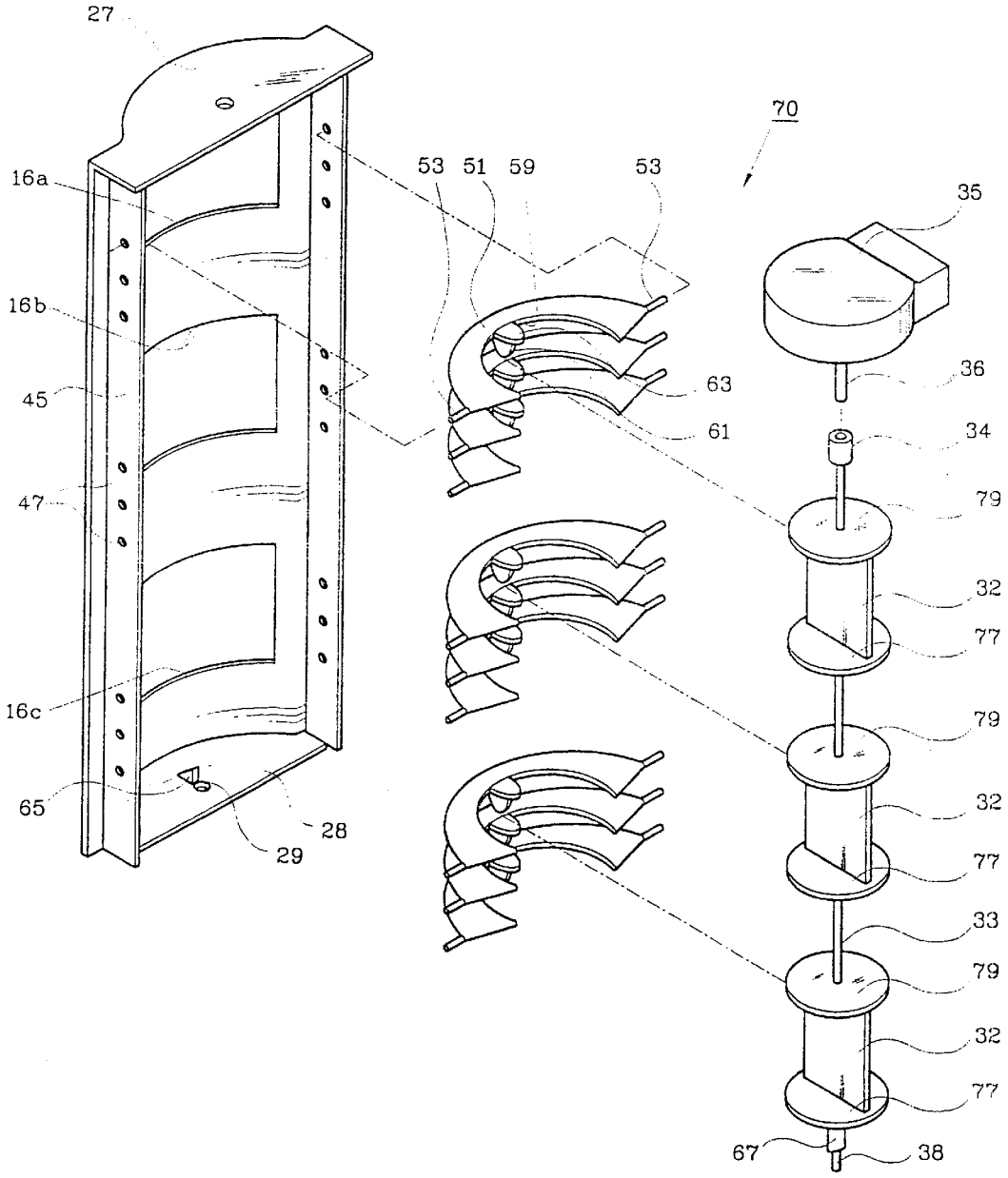
FIG. 10 is an enlarged exploded perspective view of a cool air dispersing device according to the second embodiment of the present invention.
Figure 11:
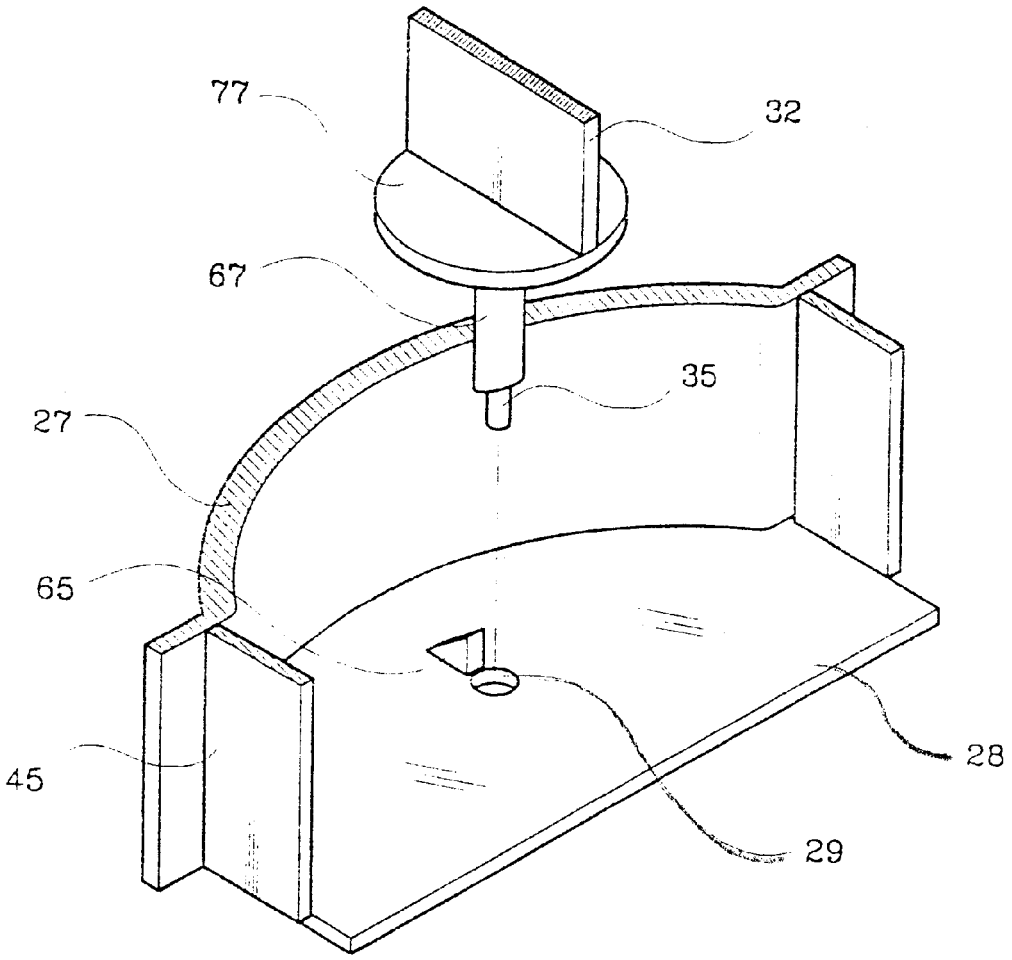
FIG. 11 is a partial enlarged view of the assembled state of FIG. 10.

FIGS. 8 and 9 show the discharge states of cool air guided by the vertical dispersing blades 51. The vertical shaft 31 is rotated continuously by the driving motor 35. When the cam plates 37 are titled upward as shown in FIG. 8 while the vertical shaft 31 is rotating, the vertical dispersing blades 51 supported by the cam plate 37 are tilted upward. Thus, the cool air in the supply duct 15 is discharged upward by the vertical dispersing blades 51.

Similarly, when the cam plates 37 are tilted downward as shown in FIG. 9 while the vertical shaft 31 is rotating, the vertical dispersing blades 51 are tilted downward, and the cool air is discharged downward.

While the vertical shaft 31 is rotating, the horizontal dispersing blades 32 rotate together with the vertical shaft 31. Therefore, the cool air is dispersed horizontally.

As such, the angular positions of the vertical dispersing blades 51 and the horizontal dispersing blades 32 are changed while the vertical shaft is rotating, so the discharge direction of cool air is consecutively changed vertically and horizontally. Therefore, the cool air is dispersed uniformly while it is supplied into the fresh food compartment 3. Moreover, since the horizontal dispersing blades 32 and the vertical dispersing blades 51 are formed into a planar plate, vortex of the cool air does not occur while they are rotating.

Meanwhile, if the concentrative supply of cool air on a specific area such as an upper area or a lower area is required, the concentrative cooling can be realized by stopping the driving motor 35 when the horizontal dispersing blades 32 and the vertical dispersing blades 51 are directed to the corresponding area. In such a situation, an additional control part should be provided which operates on the basis of the temperature sensed by the temperature sensors 19*a* and 19*b* placed in the fresh food compartment 3. If a rise in temperature of a specific area is sensed by the temperature sensors 19*a* and 19*b,* the control part stops the vertical shaft 31 so that the horizontal dispersing blades 32 and the vertical dispersing blades 51 are positioned on an angular position corresponding to the specific area. Therefore, the specific area is cooled in a concentrative manner in a short period of time, whereby the uniform distribution of cool air can be achieved more effectively.

FIGS. 10 through 13 show the cool air dispersing device 70 according to the second embodiment of the present invention. In the present embodiment, parts identical to those in the above-described first embodiment, i. e., the driving motor 35, the duct plate 27, etc., are referred to with the same reference numerals.

In the present embodiment, the construction of the vertical dispersing blades 51 is similar to that in the above-described first embodiment. However, the vertical dispersing blades 51 further comprise contact protrusions 63 besides the supporting protrusions 61, respectively. The contact protrusion 63 protrudes backward from the plane of the vertical dispersing blades 51. In the present embodiment, the vertical dispersing blades 51 are supported by a support plate 77 through the contact protrusion 63.

The support plate 77 is installed on the vertical shaft 31. The support plate 77 has a shape of a disc just like the cam plate 37 of the first embodiment. However, the support plate 77 is not tilted with respect to the vertical shaft 31 but disposed transversely to the vertical shaft 31, that is, horizontally, which is an aspect dissimilar to the cam plate 37 of first embodiment. Further, a disc-shaped guide plate 79 is also installed on the upper end of the horizontal dispersing blade 32. The guide plate 79 is disposed horizontally so as to be parallel with the support plate 77.

The vertical shaft 31 is inserted into the insertion hole 29 formed on the lower flange 28 of the duct plate 27. Thus, the vertical shaft 31 is supported so as to be capable of rotating. The insertion hole 29 has a depth enough to allow the vertical movement of the vertical shaft 31.

An elevation/de-elevation cam 67 is installed on the lower part of the vertical shaft 31. The elevation/de-elevation cam 67 is coaxially disposed with the vertical shaft 31, and the lower surface thereof is tilted to form a cam profile elevating/de-elevating vertically.

On the lower flange 28 of the duct plate 27 is formed a cam protrusion 65 which functions as a cam follower. The cam protrusion 65 is disposed near the insertion hole 29. When the lower end of the vertical shaft 31 is inserted into the insertion hole 29, the cam protrusion 65 is contacted with the lower surface of the elevation/de-elevation cam shaft 67. Therefore, while the vertical shaft 31 is rotated by the driving motor 35, the vertical shaft 31 elevates/de-elevates vertically. In the present embodiment, the elevation/de-elevation cam 67 is formed on the vertical shaft 31 and the cam protrusion 65 is formed on the lower flange 28, however, it is possible to modify them so that the elevation/de-elevation cam 67 is formed on the lower flange 28 and the cam protrusion 65 is formed on the vertical shaft 31.

The operation of the cool air dispersing device 70 according to the present embodiment is as follows.

Figure 12:
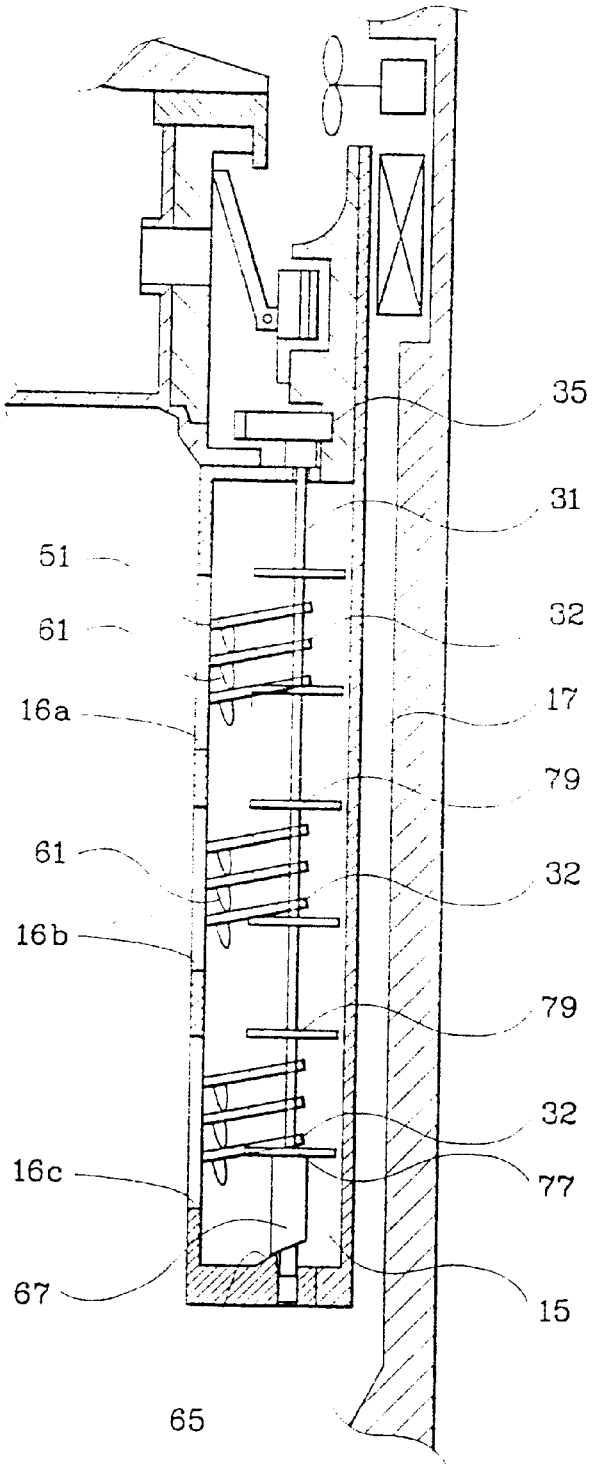
FIGS. 12 and 13 are side sectional views of the assembled state of FIG. 10.
Figure 13:
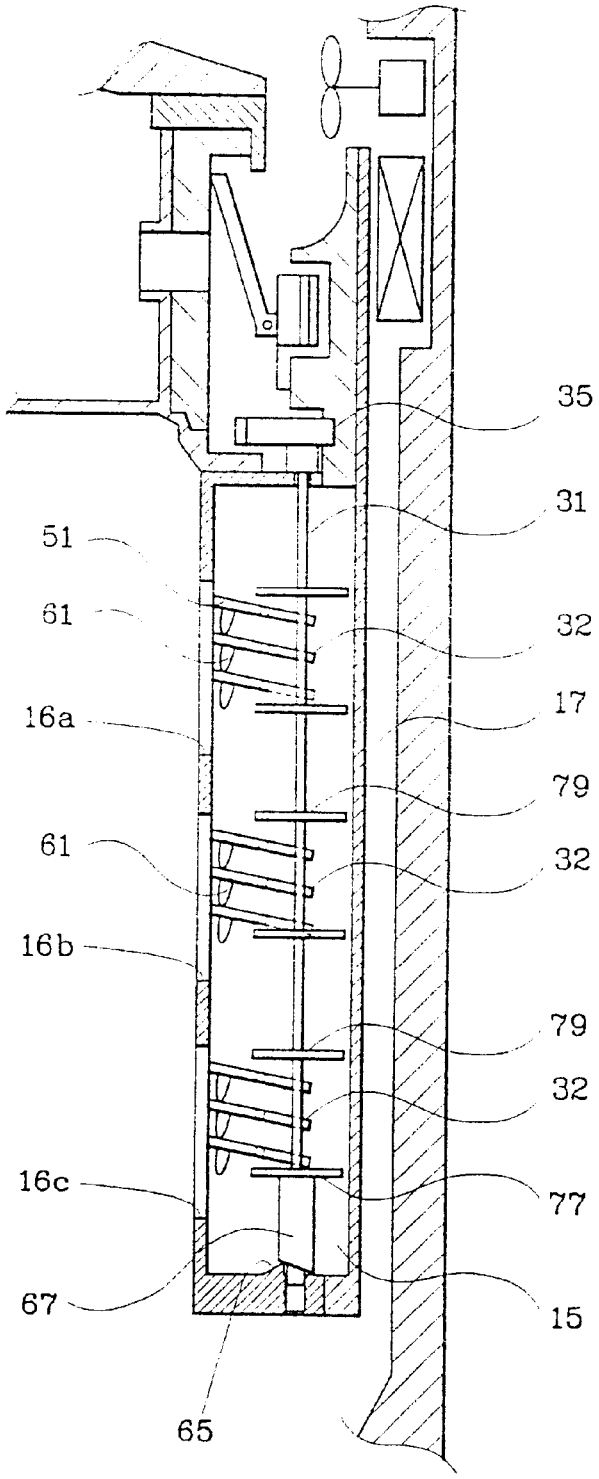

While the vertical shaft 31 is rotated by the driving motor 35, the vertical shaft 31 is elevated/de-elevated by the elevation/de-elevation cam 67 and the cam protrusions 63 supported by the support plates 77 respectively are elevated/de-elevated, whereby the vertical dispersing blades 51 reciprocate between the states that they are rotated downward as shown in FIG. 12 and rotated upward as shown in FIG. 13. Accordingly, the cool air is dispersed vertically. Furthermore, while the vertical shaft 31 is rotating, the horizontal dispersing blades 32 are rotated as those in the first embodiment do, whereby the cool air is dispersed horizontally.

As described above, according to the present invention, a stable cool air flow and a uniform distribution of cool air in vertical and horizontal directions can be achieved without the vortex of cool air about the cool air discharge ports.

Although the present invention has been described and illustrated in detail, it is clearly understood that the same is by way of illustrated and example only and is not to be taken by way of limitation, wherein the spirit and scope of the present invention is limited only by the terms of the appended claims.

What is claimed is:

1. A refrigerator comprising:

a duct plate being installed on a side wall of a cooling compartment, said duct plate for forming a cool air duct in said side wall, said duct plate having at least one cool air discharge port opened into said cooling compartment;

a plurality of vertical dispersing blades of planar plate shape being installed in said cool air duct so as to be capable of rotating with respect to a horizontal shaft, said vertical dispersing blades being disposed in parallel with each other, said vertical dispersing blades for dispersing cool air in said cool air duct vertically according to a rotational position thereof;

a vertical shaft being disposed in said cool air duct vertically, said vertical shaft being capable of rotating;

a plate being installed on said vertical shaft, said plate for supporting a part of said vertical dispersing blade, said plate being tilted at a predetermined angle; and a means for rotating said vertical shaft.

2. The refrigerator as claimed in claim 1, further comprising a supporting protrusion protruding vertically from said vertical dispersing blade, said supporting protrusion being in contact with an adjacent vertical dispersing blade so that said vertical dispersing blade maintains a predetermined distance from said adjacent vertical dispersing blade.

3. The refrigerator as claimed in claim 2, wherein said plate is in contact with said supporting protrusion formed on a lowermost vertical dispersing blade among said vertical dispersing blades.

4. The refrigerator as claimed in claim 1, further comprising a plurality of horizontal dispersing blades being installed on said vertical shaft, said horizontal dispersing blades being rotated together with said vertical shaft, said horizontal dispersing blades for dispersing cool air in said cool air duct horizontally according to a rotational position thereof.

5. The refrigerator as claimed in claim 1, wherein said plate has a shape of a disc.

6. A refrigerator comprising:

a duct plate being installed on a side wall of a cooling compartment, said duct plate for forming a cool air duct in said side wall, said duct plate having at least one cool air discharge port opened into said cooling compartment;

a plurality of vertical dispersing blades of planar plate shape being installed in said cool air duct so as to be capable of rotating with respect to a horizontal shaft, said vertical dispersing blades being disposed in parallel with each other, said vertical dispersing blades for dispersing cool air in said cool air duct vertically according to a rotational position thereof;

a vertical shaft being disposed in said cool air duct vertically so as to be capable of elevating/de-elevating vertically, said vertical shaft being capable of rotating;

a plate being installed on said vertical shaft, said plate for supporting a part of said vertical dispersing blade; p1 a means for rotating said vertical shaft; and a means for elevating/de-elevating said vertical shaft while said vertical shaft is being rotated by said rotating means.

7. The refrigerator as claimed in claim 6, wherein said elevating/de-elevating means comprises:

an elevation/de-elevation cam being installed on said vertical shaft, said elevation/de-elevation cam having a cam profile elevating/de-elevating vertically; and a cam protrusion being formed on a part of said duct plate, said cam interacting with said elevation/de-elevation cam.

8. The refrigerator as claimed in claim 1, further comprising a supporting protrusion protruding vertically from said vertical dispersing blade, said supporting protrusion being in contact with an adjacent vertical dispersing blade so that said vertical dispersing blade maintains a predetermined distance from said adjacent vertical dispersing blade.

9. The refrigerator as claimed in claim 1, further comprising a plurality of horizontal dispersing blades being installed on said vertical shaft, said horizontal dispersing blades being rotated together with said vertical shaft, said horizontal dispersing blades for dispersing cool air in said cool air duct horizontally according to a rotational position thereof.

* * * * *